United States Patent [19]

Toyama

[11] 4,226,006

[45] Oct. 7, 1980

[54] BILLFOLD SAFETY CLIP

[76] Inventor: James Toyama, 1980 Cedar Ave., Long Beach, Calif. 90806

[21] Appl. No.: 918,110

[22] Filed: Jun. 22, 1978

[51] Int. Cl.[2] ..... A44B 21/00

[52] U.S. Cl. ..... 24/3 L; 24/259 R

[58] Field of Search ..... 24/3 H, 3 J, 3 L, 259 R, 24/67.9, 3 R, 3 M, 3 E, 3 G, 3 K, 81 WP, 81 ME; 150/47

[56] References Cited

U.S. PATENT DOCUMENTS

| | | | |
|---|---|---|---|
| 1,372,959 | 3/1921 | Klenck | 24/3 R |
| 1,392,715 | 8/1921 | Sommer | 24/3 K |
| 1,473,361 | 11/1923 | Tebbetts | 24/3 K |
| 1,516,035 | 11/1924 | Adamich | 24/3 H |
| 1,553,169 | 9/1925 | Johnson | 24/3 J |
| 1,555,714 | 9/1925 | Kahn | 24/3 L |
| 1,857,488 | 5/1932 | Weeks | 24/259 R |
| 2,009,941 | 7/1935 | Mix | 24/259 R |
| 2,150,497 | 3/1939 | Fernberg | 24/259 R |
| 2,419,092 | 4/1947 | Schupbach | 150/47 |
| 2,535,834 | 12/1950 | Born | 24/3 H |
| 2,595,843 | 5/1952 | Grabhorn | 24/259 R |
| 2,614,305 | 10/1952 | Yeardley | 24/3 J |
| 3,027,995 | 4/1962 | Littman | 24/81 MC |
| 3,346,030 | 10/1967 | Woolf | 150/47 |
| 3,561,066 | 2/1971 | Osteen | 24/3 L |

*Primary Examiner*—J. Franklin Foss

*Attorney, Agent, or Firm*—Blair, Brown & Kreten

[57] ABSTRACT

A safety clip is provided for use with a billfold, wallet or the like wherein the safety clip consists of a piece of suitable material such as metal or plastic that includes a portion that engages a pocket of the billfold, and wherein the device is adapted to be arranged in engagement with an article of clothing or belt so as to help prevent theft of the wallet or billfold by pickpockets or the like. The device includes a main rectangular body portion as well as a tapered portion, and the construction is such that the billfold is safely retained in place so as to minimize loss of the billfold to pickpockets.

1 Claim, 4 Drawing Figures

BILLFOLD SAFETY CLIP

BACKGROUND OF THE INVENTION

Various ways have been attempted to prevent loss of articles such as billfolds to pickpockets but these prior devices have not proved satisfactory and have been cumbersome and unwieldy and not effective.

FIELD OF THE INVENTION

The present invention relates to a safety clip for preventing loss of a billfold to a pickpocket and wherein the safety clip is adapted to be made of a single piece of material such as metal or plastic that has a springiness and wherein one end of the clip is inserted into a pocket of a conventional billfold and then this portion of the billfold is placed inside of the user's trousers so that it is practically impossible for anyone to remove the billfold with the ease that a pickpocket normally can when removing a billfold from a hip pocket, inside jacket pocket or the like.

SUMMARY OF THE INVENTION

The present invention consists of a safety clip that includes a main body portion for engaging a pocket in a conventional billfold, and wherein there is provided a section or portion that is integral with the main body portion so that the safety clip can be worn on the trousers or the like to prevent pickpockets from removing the billfold from the hip pocket, inside jacket pocket or the like of the person using the same.

The primary object of the present invention is to provide a billfold safety clip that prevents a pickpocket from normally removing a billfold from a hip pocket or inside jacket pocket of the user.

Another object of the present invention is to provide a billfold safety clip that has improved characteristics or advantages as compared to previous devices.

Still another object of the present invention is to provide a billfold safety clip that is generally rugged in construction and simple and inexpensive to manufacture.

Other objects and advantages of the present invention will become apparent from the following specification when considered in the light of the attached drawings.

DESCRIPTION OF THE PREFERRED EMBODIMENT

Figure 4:
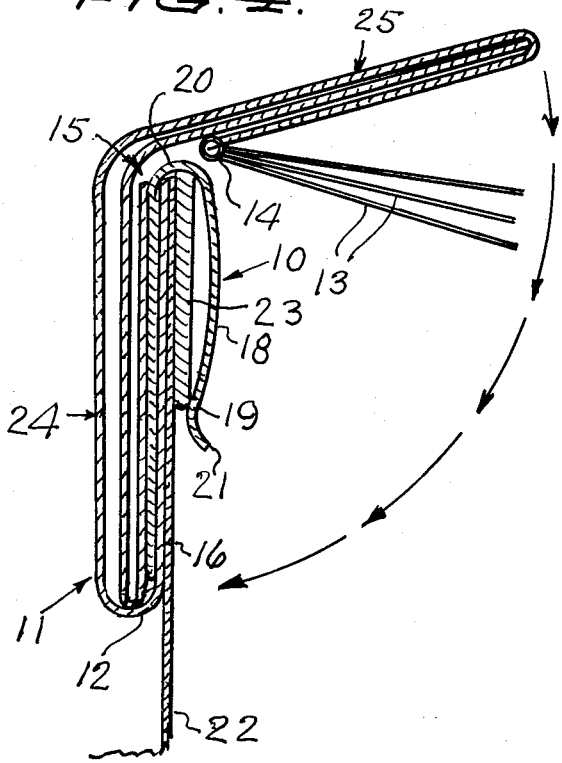
FIG. 4 is an enlarged sectional view taken on the line 4—4 of FIG. 3.

Referring in detail to the drawings, the numeral 10 indicates a safety clip for a billfold or wallet 11, and the billfold 11 includes pockets 12 and may include the usual holders or wings 13 for holding credit cards and the like, FIG. 4. The holders 13 can be hinged in place as at 14, and the numeral 15 indicates the hinge area between the sections 24 and 25 of the billfold 11.

Figure 1:
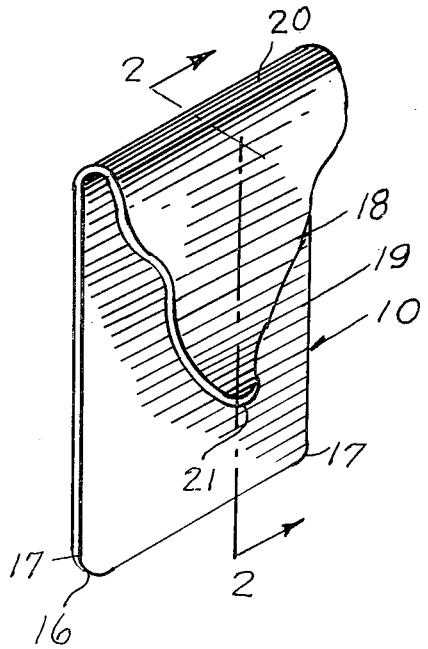
FIG. 1 is a perspective view of the billfold safety clip of the present invention.
Figure 2:
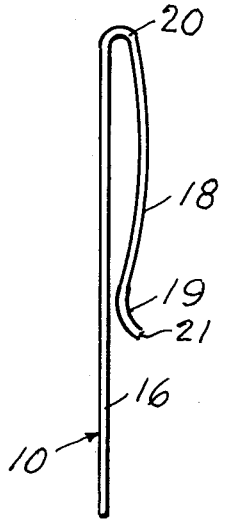
FIG. 2 is a sectional view taken on the line 2—2 of FIG. 1.
Figure 3:
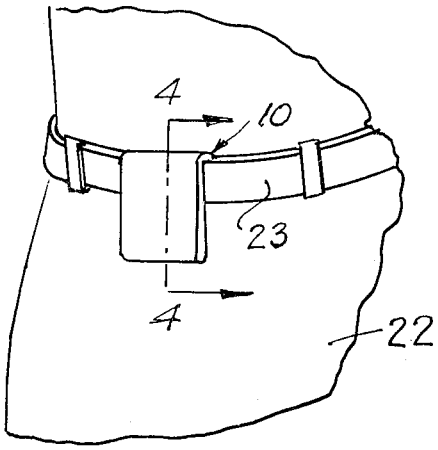
FIG. 3 is a perspective view illustrating the device in use.

As shown in FIG. 1, the billfold safety clip 10 is made of a single piece of material such as a suitable metal, plastic or the like, and the clip 10 has a springy construction and includes a generally rectangular body portion 16 that may have rounded lower corners 17. The clip 10 further includes a tapered section 18 that has a generally tapered free end 21, and the section 18 is joined to the portion 16 by means of a curved portion 20, FIG. 2. The section 18 has an offset curved section 19 which is contiguous to the body portion 16.

In FIG. 4, the numeral 22 indicates a portion of an article of clothing such as trousers that may have a waist belt 23 adjacent thereto.

From the foregoing, it will be seen that there has been provided a billfold safety clip, and in use with the parts arranged as shown in the drawings, the portion 16 is adapted to be arranged in engagement with a pocket such as the pocket 12 of the billfold 11 and the portion 20 of the clip extends over the trousers 22 and over the belt 23 and the portion 18 with the offset curved section 19 exerts a clamping action so that pickpockets cannot readily remove the billfold from the person using the device.

The parts can be made of any suitable material and in different shapes or sizes as desired or required.

It will be seen that the billfold 11 can be arranged so that the portions 24 and 25 are arranged on opposite sides of the belt 23 and garment 22 and the hinge portion 15 of the billfold will be arranged adjacent to the portion 20 of the clip 10, so that the billfold will be safely held in place.

The safety clip 10 consists of a single piece of metal, plastic or the like which has a springy construction. Certain plastics have inherent springiness thereto, and also other materials such as phosphor bronze, which is normally very springy, can be ideally used for making the clip.

The safety clip is adapted to have its long end inserted into one of the pockets such as the pocket 12 of a standard billfold, and then this portion of the billfold can be placed inside the user's trousers 22, preferably in the front thereof. The small section of the clip indicated by the numeral 18 can hook over the user's belt. The device therefore makes it almost impossible for anyone to remove the billfold with the ease that a pickpocket normally uses when removing a billfold from a hip pocket, inside jacket pocket or the like. The clip can also be used in ladies' purses, and the billfold when placed in position on the user's belt is accessable to the user as desired or required.

Having thus described the preferred embodiment of the invention it should be understood that numerous structural modifications and adaptations may be resorted to without departing from the spirit of the invention.

I claim:

1. A safety clip for preventing the theft of billfolds by pickpockets comprising in combination:

a body portion of substantially planar rectangular configuration having curved bottom corners, an arcuate top portion having substantially the same width as said body portion, and a tapered portion integral with said arcuate portion facing said body portion so that an air space between said tapered portion and said body portion exists below said arcuate portion defining a substantially bulbous air space when viewed in cross section which thereafter narrows, and said tapered portion terminates in an outwardly splayed free end just below said narrow, said free end defining a point and said tapered portion extending down from the arcuate portion whereby said body portion extends within a sleeve area of the billfold which is disposed within a person's pocket, said arcuate portion lies on a top lip of the pocket and a belt worn by the person and said tapered portion substantially snaps over the belt to provide firm retention therein.

* * * * *